US011192692B2

(12) United States Patent
Wang

(10) Patent No.: US 11,192,692 B2
(45) Date of Patent: Dec. 7, 2021

(54) HANDLE STRUCTURE

(71) Applicant: Ting-Jui Wang, New Taipei (TW)

(72) Inventor: Ting-Jui Wang, New Taipei (TW)

( * ) Notice: Subject to any disclaimer, the term of this patent is extended or adjusted under 35 U.S.C. 154(b) by 161 days.

(21) Appl. No.: 16/653,264

(22) Filed: Oct. 15, 2019

(65) Prior Publication Data

US 2020/0122890 A1 Apr. 23, 2020

(30) Foreign Application Priority Data

Oct. 19, 2018 (TW) ..... 107137049

(51) Int. Cl.
*B65D 25/28* (2006.01)

(52) U.S. Cl.
CPC .... *B65D 25/2835* (2013.01); *B65D 2525/288* (2013.01)

(58) Field of Classification Search
CPC ..... B65D 25/28; B65D 5/46144; B65D 5/46128; B65D 5/4612; B65D 5/46112; B65D 5/46104; B65D 5/46096; B65D 5/46024; B65D 5/46016; B65D 5/46; B65D 5/4208; B65D 25/2835; B65D 2525/288; E05B 1/00; A45C 13/26
See application file for complete search history.

(56) References Cited

U.S. PATENT DOCUMENTS 1,711,749 A * 5/1929 Schmitt ..... A47J 36/10 220/264
3,107,029 A * 10/1963 Rylander ..... A47G 23/0266 220/740
3,640,420 A * 2/1972 Carter ..... A45C 13/26 220/592.2
5,075,925 A 12/1991 Maloney
5,129,537 A * 7/1992 Bordner ..... B65D 45/345 220/320
6,033,178 A * 3/2000 Cummins ..... B60R 9/06 224/402
6,923,485 B1 * 8/2005 Bauswell ..... E04F 21/02 294/3.5
8,251,248 B1 * 8/2012 Holmes ..... B65F 1/1473 220/759
8,485,388 B2 * 7/2013 Tuan ..... A47G 19/12 220/666

* cited by examiner

*Primary Examiner* — Kareen K Thomas
(74) *Attorney, Agent, or Firm* — Schmeiser, Olsen & Watts, LLP

(57) ABSTRACT

A handle structure includes a handgrip body and at least one rotating body. The rotating body is pivotally connected to the handgrip body, the rotating body is used to pivotally connect a first object, and when rotating, the rotating body drives the handgrip body to move toward the first object for reducing the height of the handle structure. Therefore, the handle structure can make a handgrip body moved out toward a direction distant from the first object when used, and can make the handgrip body moved in toward a direction of the first object when not in use for reducing the height of the handgrip body so as to operate and use easily and prevent collision.

12 Claims, 6 Drawing Sheets

HANDLE STRUCTURE

CROSS-REFERENCE TO RELATED APPLICATION

This non-provisional application claims priority under 35 U.S.C. § 119(a) on Patent Application No(s). 107137049 filed in Taiwan, R.O.C. on Oct. 19, 2018, the entire contents of which are hereby incorporated by reference.

BACKGROUND OF THE INVENTION

1. Field of the Invention

The present disclosure relates to a handle structure, and in particular to a handle structure which can make a handgrip body moved out or moved in so as to operate and use easily and prevent collision.

2. Description of the Related Art

To facilitate carrying or handling general objects (e.g. chassis, box body, door body . . . ), handles are usually mounted on the objects so that the user can apply a force for use as carrying or handling.

In the case of the above-mentioned handle, it is fixed to the outside of the object with screws locking at both ends, and cannot be folded after mounting so that the handle is normally protruding out of the surface of the object. It not only causes the interference of placing the object (because the handle protrudes out of the object so that the object cannot nestle up to the surface of the wall), or causes collision when the handle is not used, but also causes the handle dropping so as not to be used due to the screws getting loose after the handle has been used for a period of time.

BRIEF SUMMARY OF THE INVENTION

An objective of the present disclosure is to provide a handle structure, and in particular to a handle structure which can make a handgrip body moved out toward a direction distant from the first object when used, and can make the handgrip body moved in toward a direction of the first object when not in use for reducing the height of the handgrip body so as to operate and use easily and prevent collision.

To achieve at least the above objective, the present disclosure provides a handle structure, comprising: a handgrip body and at least one rotating body. The rotating body is pivotally connected to the handgrip body, the rotating body is used to pivotally connect a first object, and when rotating, the rotating body drives the handgrip body to move toward the first object for reducing the height of the handle structure.

The present disclosure further provides a handle structure, comprising: a handgrip body and two rotating bodies. Each rotating body is pivotally connected to the handgrip body respectively, each rotating body is used to pivotally connect a first object, and when rotating, each rotating body drives the handgrip body to move toward the first object for reducing the height of the handle structure.

The present disclosure still provides a handle structure, comprising: a handgrip body and at least one rotating body. The rotating body is connected to the handgrip body, the rotating body is used to pivotally connect a first object, and when rotating, the rotating body drives the handgrip body to move toward the first object for reducing the height of the handle structure.

With the above embodiments, the invention provides a handle structure which can make a handgrip body moved out toward a direction distant from the first object when used, and can make the handgrip body moved in toward a direction of the first object when not in use for reducing the height of the handgrip body so as to operate and use easily and prevent collision.

In an embodiment, the handgrip body and the rotating body are pivotally connected by a pivot portion.

In an embodiment, the first object has a body, the body has an assembling portion, and the assembling portion is used to assemble with a second object.

In an embodiment, the assembling portion has a feeding space, and the assembling portion is used to be squeezed by an external force so that a material of the second object flows into or enters the feeding space to combine the first object with the second object, or the assembling portion is used to be squeezed by an external force to deform and abut on the second object for assembling the first object with the second object.

In an embodiment, the assembling portion is a locking portion or fastening portion, and is used to assemble with the second object, or the assembling portion is locking the second object by the cooperation of a docking piece or fastening the second object, or the assembling portion has a soldering layer, and the soldering layer is used to weld to the second object after heating.

In an embodiment, the first object and the rotating body are pivotally connected by a pivot portion.

In an embodiment, the pivot portion is a shaft portion, the shaft portion has a stopping portion, and the stopping portion is used to stop movably with the first object for limiting position.

In an embodiment, an elastic element is provided between the shaft portion and the first object, and the elastic element has two ends respectively abutting against the first object and the shaft portion.

In an embodiment, the rotating body carries out a rotation or abutting to position by an elastic assistance of the elastic element.

In an embodiment, the shaft portion extends out of the first object so that an extending amount is existed between the rotating body and the first object.

In an embodiment, the rotating body has a support portion, and the support portion supports or relies on or abuts for standing or abuts for standing temporarily with the first object.

In an embodiment, the handgrip body or the rotating body has at least one track portion, and the rotating body or the handgrip body rotates and moves in the track portion.

In an embodiment, an elastic element is provided between the rotating body and the first object, and the elastic element has two ends respectively abutting against the rotating body and the first object.

In an embodiment, the rotating body abuts toward the first object or fails to abut toward the first object normally or abnormally by the rotating body abutting against the elastic element.

In an embodiment, the pivot portion is a pillar body, convex body, concave body, fastening body, hook body, groove body, perforation or rivet.

In an embodiment, the extending amount is between 0.1 mm and 500 mm.

In an embodiment, the rotating body has a pulling portion, and the pulling portion is used to pull the rotating body to perform a rotation.

In order to describe the embodiments of the invention or technical solutions in the state of the art more clearly, the drawings that is required using to describe the embodiments will be simply introduced. It is obvious that the drawings described in the following content are merely some embodiments of the invention, other drawings can be obtained by one skilled in the art based on the drawings without paying the inventive work.

DETAILED DESCRIPTION OF THE INVENTION

To facilitate understanding of the object, characteristics and effects of this present disclosure, embodiments together with the attached drawings for the detailed description of the present disclosure are provided.

Figure 1:
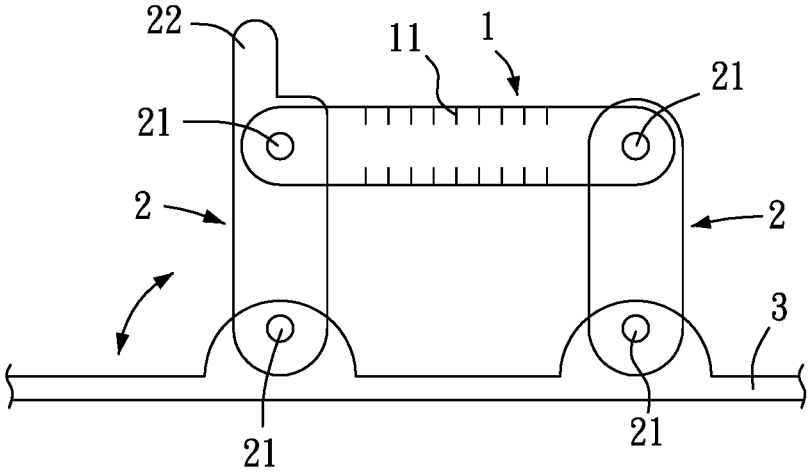
FIG. 1 is a schematic view 1 of the state of in use according to a first embodiment of the present disclosure.
Figure 2:
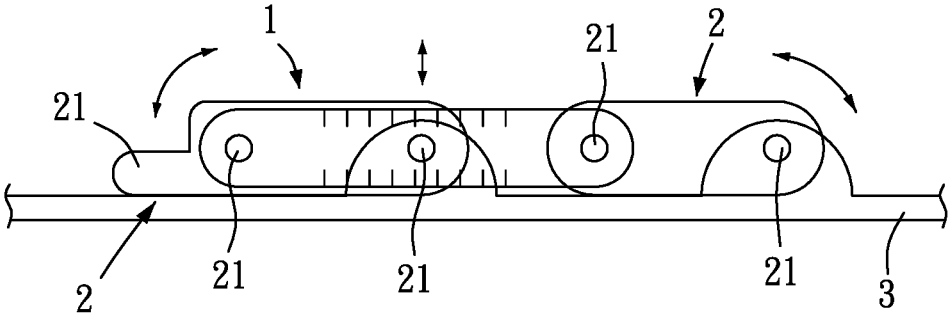
FIG. 2 is a schematic view 2 of the state of in use according to the first embodiment of the present disclosure.

Referring to FIGS. 1 and 2. As shown in the drawings, the invention provides a handle structure which comprises a handgrip body 1 and at least one rotating body 2.

The rotating body 2 is pivotally connected (or connected) to the handgrip body 1, the rotating body 2 is used to pivotally connect a first object 3, and when rotating, the rotating body 2 can drive the handgrip body 1 to move toward the first object 3 for reducing the height of the handle structure.

When the handle structure is in use, the rotating body 2 may be applied by an upward external force so that the rotating body 2 can be moved upwards, and the handgrip body 1 can be moved out toward a direction distant from the first object 3. Therefore, the handgrip body 1 can be applied by a force for moving the first object 3. When the handle structure is not in use, the rotating body 2 may be applied by a downward external force so that the rotating body 2 can be moved downwards, and the rotating body 2 and the handgrip body 1 abut simultaneously on the first object 3 to make the handgrip body 1 moved in toward a direction of the first object 3 for reducing the height of the handle structure so as to operate and use easily and prevent collision.

In an embodiment of the invention, when the handgrip body 1 and the rotating body 2 of the invention are assembled, the handgrip body 1 and the rotating body 2 are pivotally connected by at least one pivot portion 21. The pivot portion 21 may be a pillar body, convex body, concave body, fastening body, hook body, groove body, perforation or rivet. In the embodiment, the number of the rotating body 2 may be two, the number of the handgrip body 1 may be one, and the rotating bodies 2, 2 are correspondingly provided at two sides of the handgrip body 1. One end of each rotating body 2 is pivotally connected with the first object 3 respectively by the pivot portion 21, and another end of each rotating body 2 is pivotally connected with the handgrip body 1 respectively by the pivot portion 21.

Therefore, the rotating body 2 at one of the sides can be applied by an external force so that the rotating body 2 can be moved by the cooperation of every pivot portion 21 and drive the handgrip body 1, and the handgrip body 1 can drive another rotating body 2 by every pivot portion 21, and then the handgrip body 1 can be moved out toward a direction distant from the first object 3, or the rotating body 2 and the handgrip body 1 abut simultaneously on the first object 3 to make the handgrip body 1 moved in toward a direction of the first object 3 so as to operate and use easily and prevent collision.

In an embodiment of the invention, the handgrip body 1 has an anti-skid portion 11 thereon, and one end of the rotating body 2 has a pulling portion 22. Accordingly, the pulling portion 22 can be applied by a force for pulling the rotating body 2 to perform a rotation so as to operate by applying a force easily. In addition, when the handgrip body 1 is applied by a force for moving the first object 3, the anti-skid portion 11 can be used to achieve the effects of skid resistance and applying a force easily.

Referring to FIGS. 3-7. As shown in the drawings, the first object 3 has a body in the embodiment. The body has an assembling portion 31, and the assembling portion 31 is used to assemble with a second object 4. Also, the first object 3 is pivotally connected with the rotating body 2 by a pivot portion, and the pivot portion is a shaft portion 32. The shaft portion 32 is pivotally connected with the rotating body 2, and the shaft portion 32 has a stopping portion 321. The stopping portion 321 is used to stop movably with the first object 3 for limiting position, and an elastic element 33 is provided between the shaft portion 32 and the first object 3. The elastic element 33 has two ends respectively abutting against the first object 3 and the shaft portion 32, wherein each number of the first object 3, the shaft portion 32 and the rotating body 2 may be two, and the number of the handgrip body 1 may be one.

Accordingly, when the rotating body 2 at one of the sides is applied by an external force, the rotating body 2 can drive the handgrip body 1, and the handgrip body 1 can drive another rotating body 2, and then the handgrip body 1 can be moved out toward a direction distant from the first object 3, or the rotating body 2 and the handgrip body 1 abut simultaneously on the first object 3 to make the handgrip body 1 moved in toward a direction of the first object 3. When the handgrip body 1 is moved out, the stopping portion 321 stops with the first object 3 for limiting position to prevent the shaft portion 32 and the rotating body 2 being separated. When the handgrip body 1 is moved out or moved in, the rotating body 2 carries out a rotation or abutting to position by an elastic assistance of the elastic element 33 so as to operate and use easily and prevent collision.

In the embodiment, the shaft portion 32 may extend out of the first object 3 so that an extending amount a is existed between the rotating body 2 and the first object 3 (as shown in the right side of FIG. 4), and the extending amount a is between 0.1 mm and 500 mm. Also, the rotating body 2 may have a support portion 23 at another end, and the support portion 23 supports or relies on (as shown in the left side of FIG. 4) or abuts for standing or abuts for standing temporarily with the first object 3 so that the invention can further meet the need of the practical use.

Figure 5:
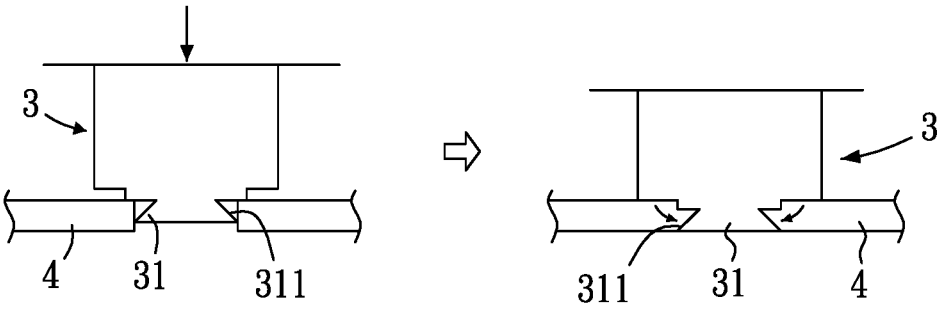
FIG. 5 is a schematic view 1 illustrating a connection of a first object and a second object according to the present disclosure.
Figure 6:
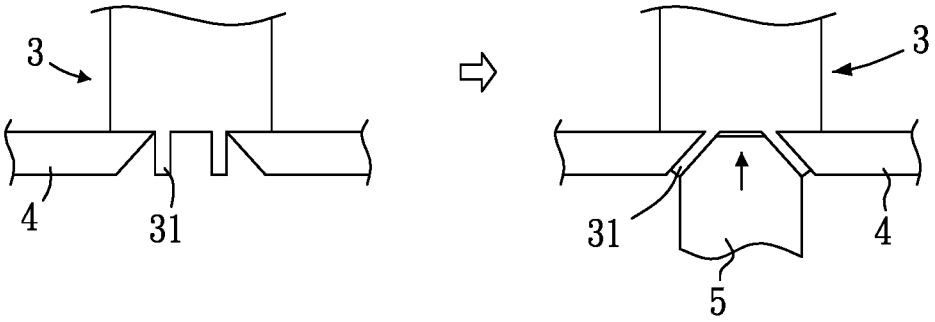
FIG. 6 is a schematic view 2 illustrating a connection of a first object and a second object according to the present disclosure.

In addition, the assembling portion 31 has a feeding space 311, and the assembling portion 31 can be squeezed by an external force so that a material of the second object 4 flows into or enters the feeding space 311 to combine the first object 3 with the second object 4 (as shown in FIG. 5), or the assembling portion 31 can be squeezed by an external force with a tool 5 to deform and abut on the second object 4 for assembling the first object 3 with the second object 4 (as shown in FIG. 6).

Figure 3:
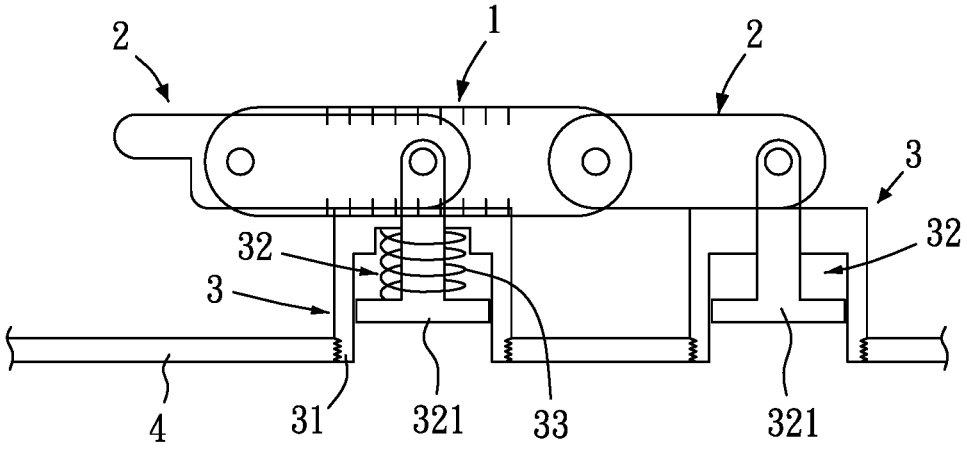
FIG. 3 is a schematic view of the sectional state according to a second embodiment of the present disclosure.
Figure 4:
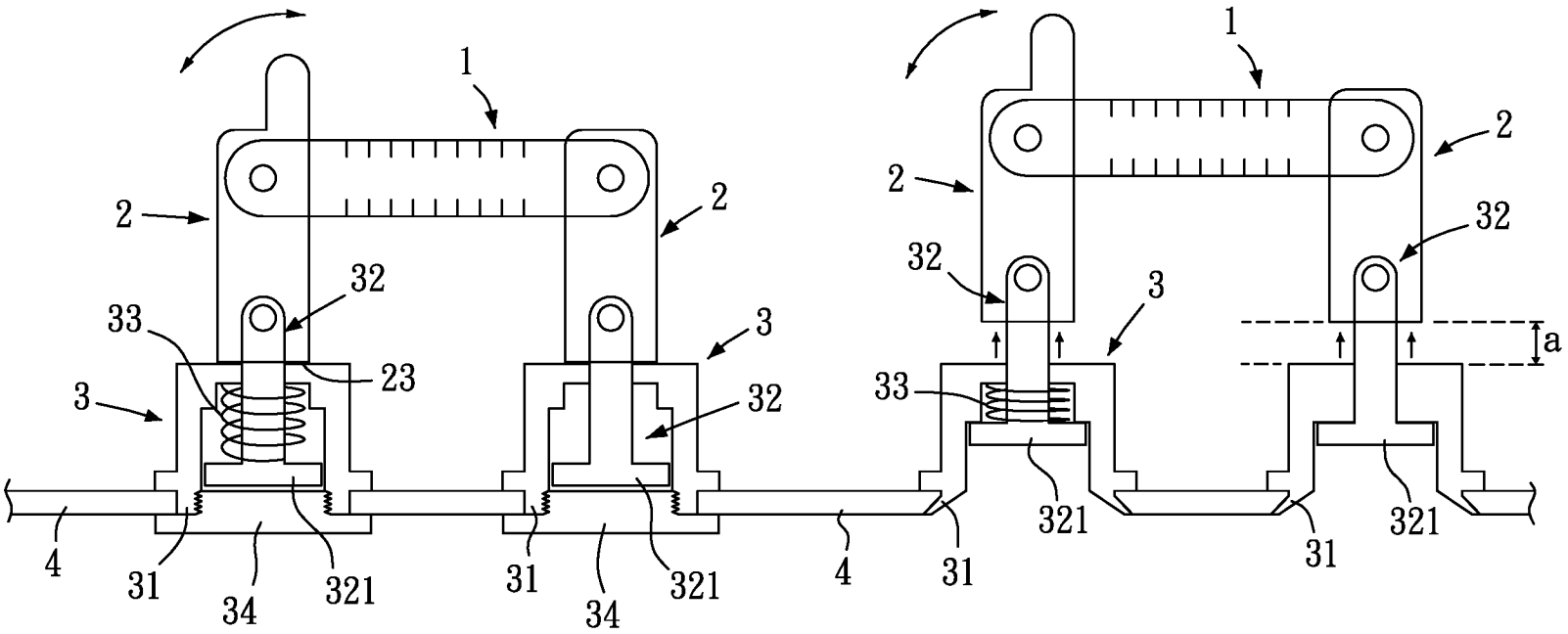
FIG. 4 is a schematic view of the sectional state according to a third embodiment of the present disclosure.
Figure 7:
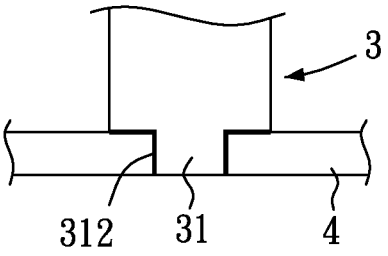
FIG. 7 is a schematic view 3 illustrating a connection of a first object and a second object according to the present disclosure.

Further, the assembling portion 31 is a locking portion or fastening portion, and is used to assemble with the second object 4 (as shown in FIG. 3), or the assembling portion 31 is locking the second object 4 by the cooperation of a docking piece 34 or fastening the second object 4 (as shown in the right side of FIG. 4), or the assembling portion 31 has a soldering layer 312, and the soldering layer 312 is used to weld to the second object 4 after heating (as shown in FIG. 7). Accordingly, the first object 3 combines with the second object 4 in different manners according to the need of the practical use.

Figure 8:
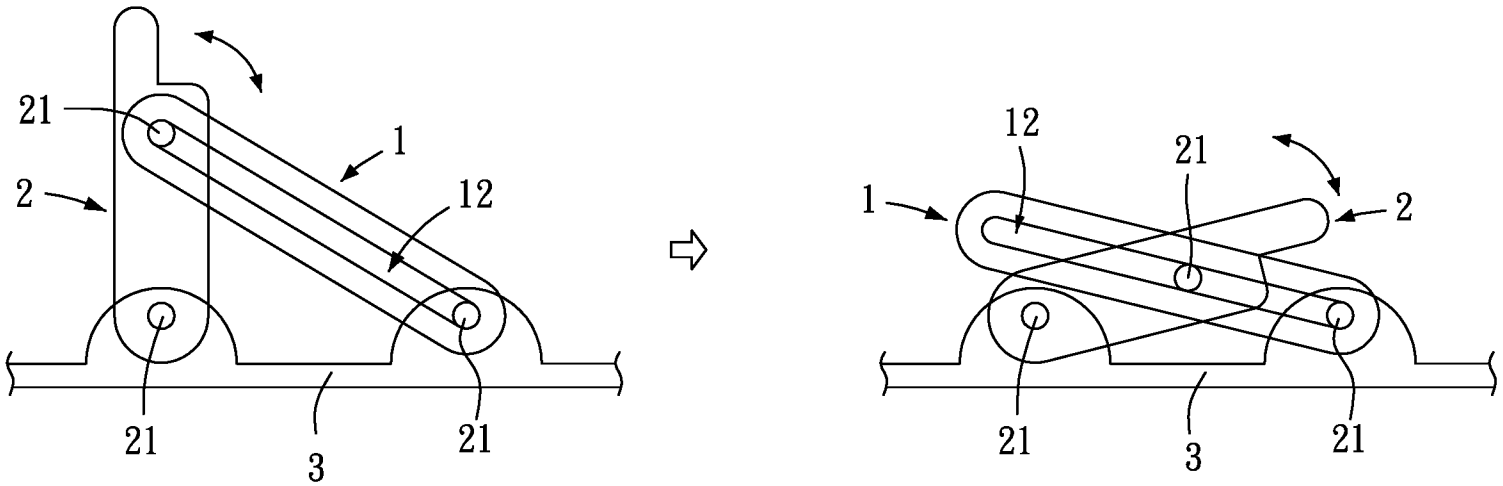
FIG. 8 is a schematic view of the sectional state according to a fourth embodiment of the present disclosure.

Referring to FIG. 8. As shown in the drawing, the handgrip body 1 has at least one track portion 12 in the embodiment. The rotating body 2 can rotate and move in the track portion 12. Also, each number of the handgrip body 1 and the rotating body 2 may be one, and the rotating body 2 is correspondingly provided at one side of the handgrip body 1. One end of the rotating body 2 and one end of the handgrip body 1 are pivotally connected with the first object 3 respectively by pivot portions 21, 21, and another end of the rotating body 2 is pivotally connected with the track portion 12 of the handgrip body 1 by a pivot portion 21*a*. Therefore, the rotating body 2 can be applied by an external force so that the rotating body 2 can be moved on the first object 3 by the cooperation of every pivot portion 21, and rotated in the track portion by the cooperation of the pivot portion 21*a* to drive the handgrip body 1, and the handgrip body 1 can be moved out toward a direction distant from the first object 3 by the pivot portions 21, 21*a*, or the rotating body 2 and the handgrip body 1 abut simultaneously on the first object 3 to make the handgrip body 1 moved in toward a direction of the first object 3 so as to operate and use easily and prevent collision. In addition, a track portion can also be provided in the rotating body 2 to make the handgrip body 1 rotated and moved in the track portion (not shown in the drawings).

Figure 9:
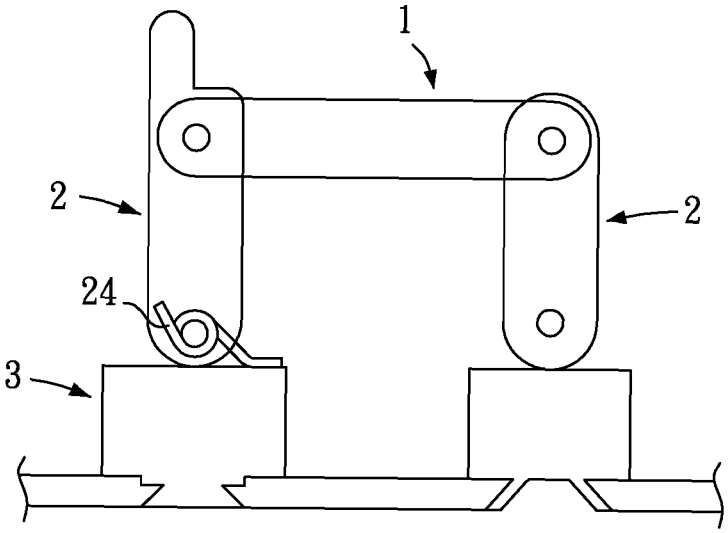
FIG. 9 is a schematic view of the state of in use according to a fifth embodiment of the present disclosure.

Referring to FIG. 9. As shown in the drawing, an elastic element 24 is provided between the rotating body 2 and the first object 3 in the embodiment. The elastic element 24 has two ends respectively abutting against the rotating body 2 and the first object 3. Accordingly, the rotating body 2 abuts toward the first object 3 (or fails to abut toward the first object 3) normally or abnormally by the rotating body 2 abutting against the elastic element 24 so that the rotating body 2 can accomplish the positioning effect by abutting against elastic element 24 after the rotating body 2 makes the handgrip body 1 moved out or moved in to prevent the handgrip body 1 from moving out or moving in accidentally due to the influence of an external force when used or not in use.

In summary, the embodiments of the invention provide a handle structure which can make a handgrip body moved out toward a direction distant from the first object when used, and can make the handgrip body moved in toward a direction of the first object when not in use for reducing the height of the handgrip body so as to operate and use easily and prevent collision.

The above description is merely embodiments of the invention, and it should not be considered to limit the scope of the invention.

While the present disclosure has been described by means of specific embodiments, numerous modifications and variations could be made thereto by those skilled in the art without departing from the scope and spirit of the present disclosure set forth in the claims.

What is claimed is:

1. A handle structure, comprising:

a handgrip body; and at least one rotating body, pivotally connected to the handgrip body, the rotating body is used to pivotally connect a first object, and when rotating, the rotating body drives the handgrip body to move toward the first object for reducing the height of the handle structure;

wherein the first object has a body, the body has an assembling portion, and the assembling portion is used to assemble with a second object;

wherein the assembling portion has a feeding space, and the assembling portion is used to be squeezed by an external force so that a material of the second object flows into or enters the feeding space to combine the first object with the second object, or the assembling portion is used to be squeezed by an external force to deform and abut on the second object for assembling the first object with the second object.

2. The handle structure according to claim 1, wherein the handgrip body and the rotating body are pivotally connected by a pivot portion.

3. The handle structure according to claim 1, wherein the rotating body has a support portion, and the support portion supports or relies on or abuts for standing or abuts for standing temporarily with the first object.

4. The handle structure according to claim 1, wherein the handgrip body or the rotating body has at least one track portion, and the rotating body or the handgrip body rotates and moves in the track portion.

5. The handle structure according to claim 1, wherein an elastic element is provided between the rotating body and the first object, and the elastic element has two ends respectively abutting against the rotating body and the first object.

6. The handle structure according to claim 5, wherein the rotating body abuts toward the first object or fails to abut toward the first object normally or abnormally by the rotating body abutting against the elastic element.

7. The handle structure according to claim 2, wherein the pivot portion is a pillar body, convex body, concave body, fastening body, hook body, groove body, perforation or rivet.

8. The handle structure according to claim 1, wherein the rotating body has a pulling portion, and the pulling portion is used to pull the rotating body to perform a rotation.

9. A handle structure comprising:

a handgrip body; and two rotating bodies, each rotating body is pivotally connected to the handgrip body respectively, each rotating body is used to pivotally connect a first object, and when rotating, each rotating body drives the handgrip body to move toward the first object for reducing the height of the handle structure.

10. A handle structure, comprising:

a handgrip body; and at least one rotating body, pivotally connected to the handgrip body, the rotating body is used to pivotally connect a first object, and when rotating, the rotating body drives the handgrip body to move toward the first object for reducing the height of the handle structure;

wherein the first object and the rotating body are pivotally connected by a pivot portion, the pivot portion is a shaft portion, and an elastic element is provided between the shaft portion and the first object.

11. A handle structure, comprising:

a handgrip body; and at least one rotating body, pivotally connected to the handgrip body, the rotating body is used to pivotally connect a first object, and when rotating, the rotating body drives the handgrip body to move toward the first object for reducing the height of the handle structure;

wherein the handgrip body or the rotating body has at least one track portion, and the rotating body or the handgrip body rotates and moves in the track portion.

12. A handle structure, comprising:

a handgrip body; and at least one rotating body, pivotally connected to the handgrip body, the rotating body is used to pivotally connect a first object, and when rotating, the rotating body drives the handgrip body to move toward the first object for reducing the height of the handle structure;

wherein an elastic element is provided between the rotating body and the first object, and the elastic element has two ends respectively abutting against the rotating body and the first object.

* * * * *